US005332027A

United States Patent [19]

Kageyama et al.

[11] Patent Number: 5,332,027

[45] Date of Patent: Jul. 26, 1994

[54] ELECTROMAGNETIC BRAKING APPARATUS FOR CONTINUOUS CASTING MOLD

[75] Inventors: Ryuichi Kageyama; Toshio Kikuchi, both of Kitakyushu, Japan

[73] Assignee: Nippon Steel Corporation, Tokyo, Japan

[21] Appl. No.: 28,814

[22] Filed: Mar. 10, 1993

[51] Int. Cl.[5] ..... B22D 27/02

[52] U.S. Cl. ..... 164/502; 164/466

[58] Field of Search ..... 164/502, 504, 466, 468

[56] References Cited

FOREIGN PATENT DOCUMENTS

| | | |
|---|---|---|
| 0117115 | 8/1984 | European Pat. Off. . |
| 0401504 | 12/1990 | European Pat. Off. . |
| 0445328 | 9/1991 | European Pat. Off. . |
| 2248103 | 5/1975 | France . |
| 58-55157 | 4/1984 | Japan . |
| 2-20349 | 5/1990 | Japan . |
| 2-284750 | 11/1990 | Japan . |
| 3-258442 | 11/1991 | Japan . |
| 2016977 | 9/1979 | United Kingdom . |

OTHER PUBLICATIONS

Patent Abstracts of Japan, vol. 12, No. 321 (M-736) Aug. 31, 1988 & JP-A-63090337, Sumitomo Heavy Ind. Ltd. Apr. 21, 1988 *abstract*.

Patent Abstracts of Japan, vol. 8, No. 216 (M-329) Oct. 3, 1984 & JP-A-59101261, Kawasaki Seitetsu KK, Jun. 11, 1984 *abstract*.

Patent Abstracts of Japan, vol. 13, No. 48, (M-793) Feb. 3, 1989 & JP-A-63256247 Kawasaki Steel Corporation, Oct. 24, 1988 *abstract*.

*Primary Examiner*—Kuang Y. Lin

*Attorney, Agent, or Firm*—Pollock, Vande Sande & Priddy

[57] ABSTRACT

An electromagnetic braking apparatus for a continuous casting mold comprises a casting mold with a rectangular cross section including wide side walls and narrow end walls; electromagnets each of which comprises a core disposed along the side wall of the casting mold and a coil wound around the core for applying a magnetic field in the direction across the side walls of the casting mold; and a support frame for supporting a width changing device for changing the width of the casting mold and cooling boxes for cooling the casting mold, the support frame extending to surround the casting mold and the electromagnets and connected to the cores of the electromagnets to thereby form the magnetic path of the electromagnets.

6 Claims, 3 Drawing Sheets

ELECTROMAGNETIC BRAKING APPARATUS FOR CONTINUOUS CASTING MOLD

BACKGROUND OF THE INVENTION

The present invention relates to an electromagnetic braking apparatus for controlling molten steel flowing down in a casting mold by applying an electrostatic magnetic field to the molten steel supplied from a submerged nozzle into the casting mold, in the continuous casting of the molten steel.

A method of controlling molten steel flowing down in a casting mold by applying an electrostatic magnetic field to the molten steel supplied into the casting mold is effective to gather and catch inclusions and prevent the entrapment of powders and bubbles when killed steel and in particular low carbon Al killed steel is continuously cast at a high speed.

Electromagnetic braking apparatuses used to this method are disclosed in Japanese Patent Examined Publication No. 2-20349 and Japanese Patent Unexamined Publication No. 2-284750 and generally have the arrangement shown in FIGS. 1 and 2. A casting mold 1 with a rectangular cross section has wide side walls 2 and narrow end walls 3. An electromagnet 10 is disposed along each of the side walls 2 and has a core 7 and coil 8 wound around the core 7. A magnetic path forming iron core 13 is connected to ends of the cores 7 and extends to surround the casting mold 1 to thereby constitute an electromagnet device for applying an electrostatic magnetic field in the direction across the side walls 2 of the casting mold 1. The electromagnet device is mounted on the support frame 6 disposed on a vibration table 9. The support frame 6 further supports a cooling box 5 for cooling the casting mold 1 and width changing device 4 for changing the width of the casting mold by moving the end walls 3 of the casting mold. The magnetic path forming iron core 13 has a reduced thickness at the portion thereof to be interfered with the width changing device 4 and support frame 6 to prevent the interference with these components. Further, the corner of the magnetic path forming iron core 13 is chamfered to prevent the interference with water pipes 11 connected to the cooling boxes. Further, an opening, through which the magnetic path forming iron core 13 passes, is defined to the cooling box so that the magnetic path forming iron core 13 extends to surround the casting mold and the electromagnet.

The electromagnet device must reduce the magnetic resistance of the magnet path forming iron core to effectively produce an electrostatic magnetic field. For this purpose, the magnetic path forming iron core preferably has a large cross sectional area. Nevertheless, since the magnetic path forming iron core of the conventional electromagnetic braking apparatuses has a portion with a reduced cross sectional area to prevent the interference with other components such as the support frame, width changing device, duct and the like, the electromagnetic braking apparatus cannot produce a magnetic flux density of about 2000–5000 Gauss at the center of the casting mold. Further, when an electromagnetic device capable of producing the above magnetic flux density is provided by using an magnetic path forming iron core having a portion with a reduced cross sectional area, the weight of the magnetic path forming iron core is increased and thus the size of a support frame for supporting it is also increased. Further, a crane associated with a vibration device and continuous casting mold and a motor for the vibration device must has an increased capacity. Furthermore, another problem arises in that since the large magnetic path forming iron core extends through a cooling box, the flow of a coolant in the cooling box is obstructed.

Therefore, an object of the present invention is to provide an electromagnetic braking apparatus for a continuous casting mold capable of producing a magnetic flux density of about 2000–5000 Gauss at the center of the casting mold without increasing the weight of the continuous casting mold.

SUMMARY OF THE INVENTION

An electromagnetic braking apparatuses lot a continuous casting mold according to the present invention comprises a casting mold with a rectangular cross section including wide side walls and narrow end walls; electromagnets each of which comprises a core disposed along the side wall of the casting mold and a coil wound around the core for applying a magnetic field in the direction across the side walls of the casting mold; and a support frame for supporting a width changing means for changing the width of the casting mold and cooling boxes for cooling the casting mold, the support frame extending to surround the casting mold and the electromagnets and connected to the cores of the electromagnets to thereby form the magnetic path of the electromagnets.

The core may be integrally connected to the support frame or detachably connected thereto.

The support frame is preferably composed of a ferromagnetic material. Further, the support frame preferably has a cross sectional area sufficient to produce a magnetic flux density of 2000–5000 Gauss at the center of the casting mold.

The coil is wound around the core over the distance between the side walls and the support frame.

Since the support frame supporting the width changing means also serves as the magnetic path forming iron core of the electromagnets, a conventional magnetic path forming iron core is not needed. As a result, since spatial restriction is reduced, the size of the electromagnet can be increased as well as the cross sectional area of the support frame can be increased, without increasing the weight of the continuous casting mold, and thus a magnetic flux density of 2000–5000 Gauss can be produced at the center of the casting mold.

Further, the capacity of a vibration device and crane can be reduced. Furthermore, the flow of a coolant in the cooling box is not obstructed.

BRIEF DESCRIPTION OF THE DRAWINGS

FIGS. 1 and 2 show a conventional electromagnetic braking apparatus for a continuous casting mold, wherein:

FIG. 1 shows a perspective view, partly in cross section, of the magnetic braking apparatus;

FIG. 2 is an upper plan view of the electromagnetic braking apparatus shown by omitting cooling boxes and a width changing device for better understanding;

DESCRIPTION OF THE PREFERRED EMBODIMENT

Figure 1:
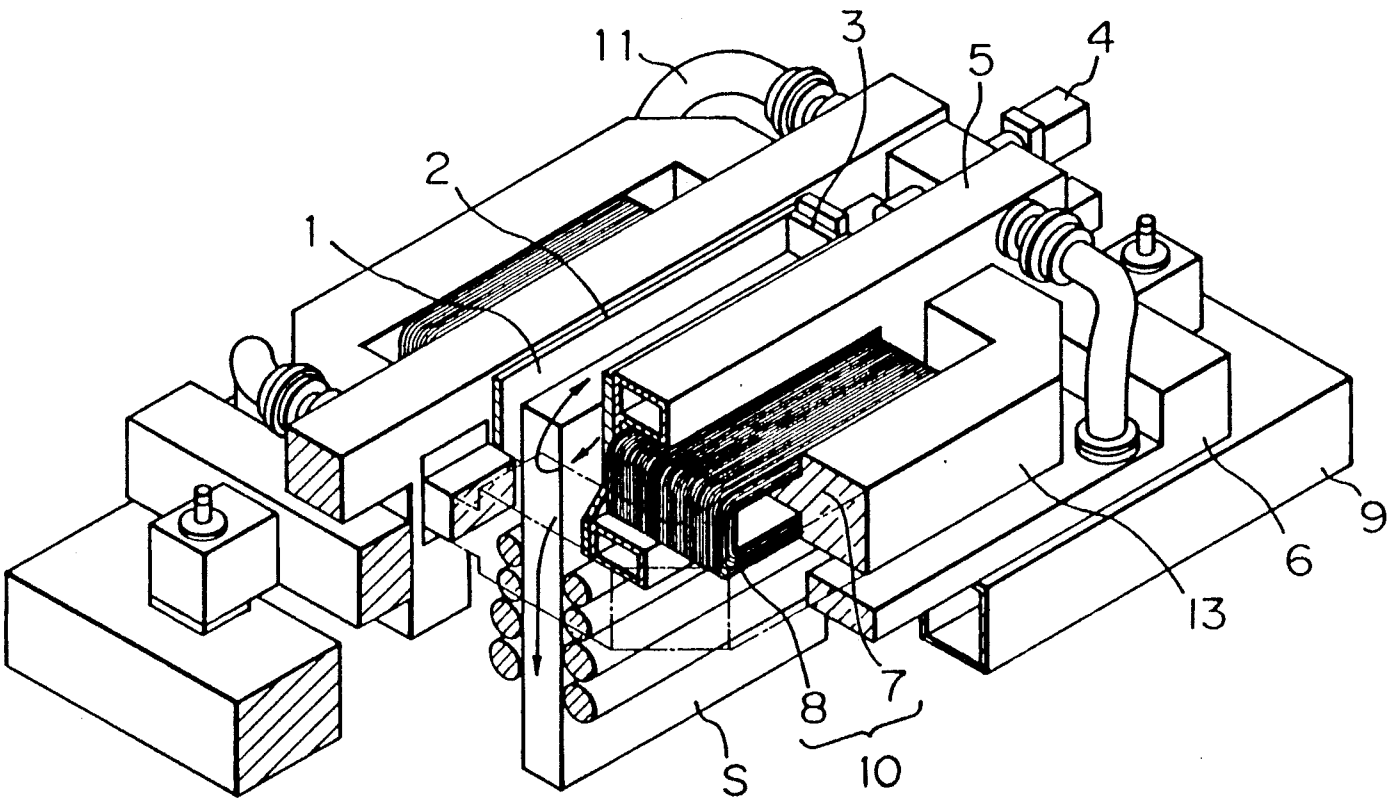
FIG. 1 PRIOR ART
Figure 2:
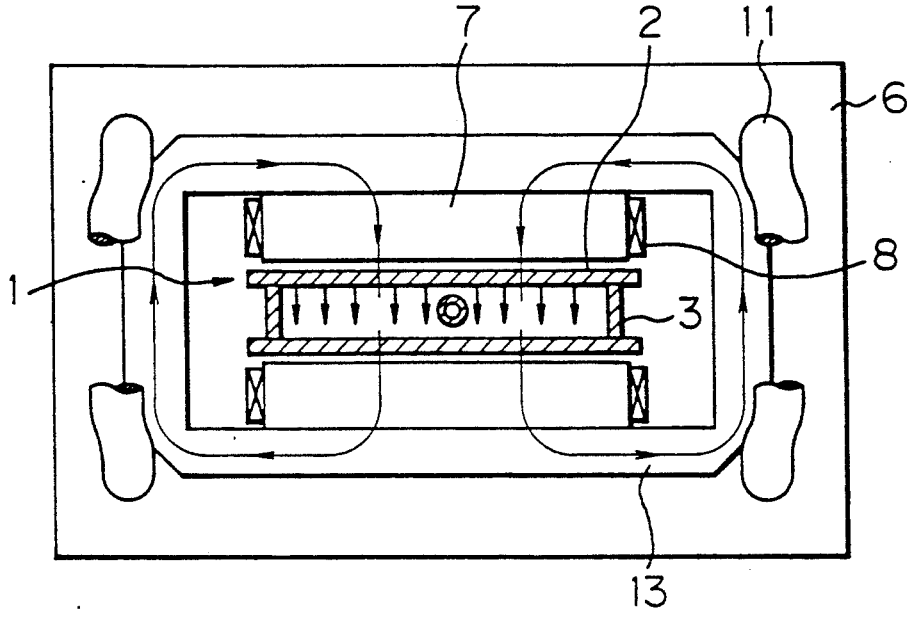
FIG. 2 PRIOR ART
Figure 3:
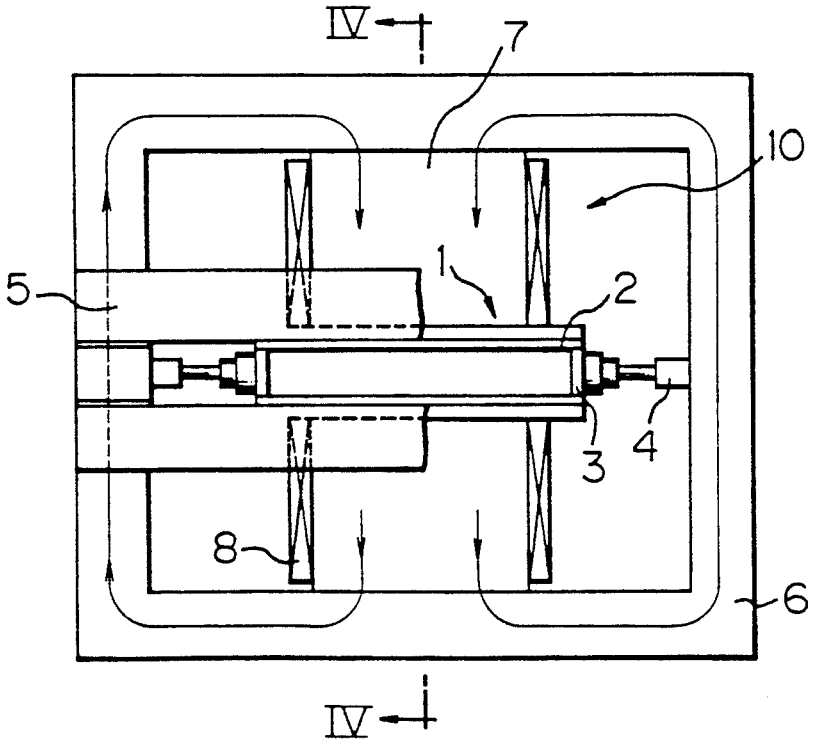
FIG. 3 shows an upper plan view of an electromagnetic braking apparatus according to the present invention.
Figure 4:
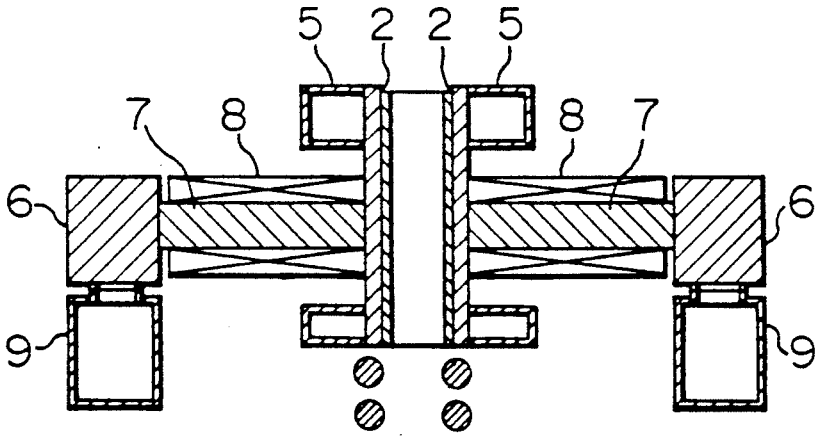
FIG. 4 shows a cross sectional view of the electromagnetic braking apparatus taken along line IV—IV of FIG. 3.

An electromagnetic braking apparatus according to the present invention will be described with reference to FIGS. 3 and 4. A casting mold 1 with a rectangular cross section includes with side walls 2 and narrow end walls 3. Electromagnets 10 are disposed along the side walls 2 and have cores 7 and coils 8 would around the cores 7. A support frame 6 is disposed on a vibration table 9 and supports cooling boxes 5 for cooling the casting mold 1 and a width changing device for changing the width of the casting mold by moving the end walls 3 of the casting mold. The end of the core 7 is integrally or detachably connected to the support frame 6 and the coil 8 is wound around the core 7 over the distance between the side wall 2 and the support frame 6. Further, the support frame 6 extends to surround the casting mold 1 and electromagnets 10 and is composed of a ferromagnetic material. The support member 6 has a cross sectional area sufficient to produce a magnetic flux density of about 2000–5000 Gauss at the center of the casting mold.

In the above structure, since an magnetic path forming iron core is not provided and the support frame 6 also serves as the magnetic path forming iron core, a space otherwise occupied by the magnetic path forming iron core can be saved and thus the weight of the continuous casting mold including the electromagnets can be reduced. Therefore, the capacity of the electromagnets 10 can be increased, whereby the braking function executed by the electromagnets can be increased and the flow of molten steel can be arbitrarily controlled.

What is claimed is:

1. An electromagnetic braking apparatus for a continuous casting mold, comprising:

a casting mold with a rectangular cross section including wide side walls and narrow end walls;

electromagnets each of which comprises a core disposed along the side wall of said casting mold and a coil wound around said core for applying a magnetic field in the direction across the side walls of said casting mold; and a support frame for supporting a width changing means for changing the width of said casting mold and cooling boxes for cooling said casting mold, said support frame extending to surround said casting mold and said electromagnets and connected to the cores of said electromagnets to thereby form the magnetic path of said electromagnets.

2. An electromagnetic braking apparatus according to claim 1, wherein said core is integrally connected to said support frame.

3. An electromagnetic braking apparatus according to claim 1, wherein said core is detachably connected to said support frame.

4. An electromagnetic braking apparatus according to claim 1, wherein said support frame comprises a ferromagnetic material.

5. An electromagnetic braking apparatus according to claim 1, wherein said support frame has a cross sectional area sufficient to produce a magnetic flux density of 2000–5000 Gauss at the center of said mold.

6. An electromagnetic braking apparatus according to claim 1, wherein said coil is wound around said core over the distance between said side wall and said support frame.

* * * * *